United States Patent [19]

Yoshimi et al.

[11] Patent Number: 4,888,927

[45] Date of Patent: Dec. 26, 1989

[54] FLOATING FLOOR

[75] Inventors: Satoshi Yoshimi, Uji; Yoichiro Koga, Okayama, both of Japan

[73] Assignee: Daiken Trade & Industry Co., Ltd., Toyama, Japan

[21] Appl. No.: 64,140

[22] Filed: Jun. 19, 1987

[30] Foreign Application Priority Data

| | | | |
|---|---|---|---|
| Jun. 19, 1986 | [JP] | Japan | 61-143432 |
| Jul. 23, 1986 | [JP] | Japan | 61-173391 |
| Feb. 6, 1987 | [JP] | Japan | 62-025765 |

[51] Int. Cl.[4] ..... E04B 1/86; E04B 5/48

[52] U.S. Cl. ..... 52/303; 52/408; 52/480; 98/DIG. 10; 248/633

[58] Field of Search ..... 52/302, 303, 408, 480, 52/167; 248/636, 638, 633, 615; 98/DIG. 10, 29, 31, 31.5

[56] References Cited

U.S. PATENT DOCUMENTS

| | | | |
|---|---|---|---|
| 1,814,979 | 7/1931 | Taylor | 98/31 |
| 2,116,654 | 5/1938 | Barge | 52/480 |
| 2,823,427 | 2/1958 | Kuhlman | 52/480 |
| 2,862,255 | 12/1958 | Nelson | 52/480 |
| 2,988,980 | 6/1961 | Tschudin | 98/31 |
| 3,201,109 | 8/1965 | Sweeney et al. | 248/633 |
| 3,316,680 | 5/1967 | Chrastek | 52/480 |
| 3,487,766 | 1/1970 | Wood | 98/31.5 |
| 3,604,173 | 9/1971 | Dahlborg | 52/480 |
| 3,657,991 | 4/1972 | Obey | 98/31 |
| 4,449,342 | 5/1984 | Abendroth | 52/480 |
| 4,554,767 | 11/1985 | Ikonomou | 52/167 |
| 4,663,909 | 5/1987 | Ogino et al. | 98/31 |

FOREIGN PATENT DOCUMENTS

| | | |
|---|---|---|
| 0109941 | 5/1984 | European Pat. Off. . |
| 823505 | 12/1951 | Fed. Rep. of Germany . |
| 2534333 | 2/1977 | Fed. Rep. of Germany . |
| 2549014 | 5/1977 | Fed. Rep. of Germany . |
| 344095 | 3/1960 | France . |
| 1450081 | 8/1966 | France . |
| 2428716 | 1/1980 | France . |
| 2461073 | 1/1981 | France . |

*Primary Examiner*—Michael Safavi

*Attorney, Agent, or Firm*—Scully, Scott, Murphy & Presser

[57] ABSTRACT

A floating floor comprises a plurality of square buffer members arranged in parallel at regular intervals on a supporting structural floor, a plurality of floor panels vertically spaced above the supporting structural floor by the supporting members to form an air layer between them. The floor panels are respectively provided with a plurality of air holes through which the air layer is communicated with the outside of the floor panels. The floor panel may be a hollow panel having a plurality of cavities extending in parallel in the longitudinal direction of the panel and being opened at butt ends of the panel, each cavity being communicted with the air layer through said air holes to form passages from the air layer to the outside of the floor panel. Instead of square buffer members, there may be used square supporting members and a buffer layer so that the floor panels are vertically spaced above the buffer layer by square supporting members to form an air layer between them.

4 Claims, 10 Drawing Sheets

FLOATING FLOOR

FIELD OF THE INVENTION

This invention relates to a floating floor and, more particularly, to a construction of floating floors in apartment buildings with high impact sound insulating performance that makes it possible to lower floor impact sounds generated by the floor under impact excitation and transmitted to the room located directly below.

BACKGROUND OF THE INVENTION

The great increase in the population and land cost has led to increases in height of apartment buildings. In such multistory apartment buildings, the floors are required to have high impact sound insulating performance to avoid a trespass on a privacy of occupants in the room located directly below. If any impact force is applied to the floor, the floor may vibrate and generate impact sounds. Such impact sounds may be divided into two groups, light-weight floor impact sounds produced by occupant activity such as walking, and heavy floor impact sounds produced by sharp transient type impulses such as caused by falling objects or a child who jumps up and down. The former, light-weight floor impact sounds are reduced effectively by laying a carpet on the floor as a finish floor since light-weight impacts may be absorbed by the carpet with ease. It is, however, difficult with the carpet to reduce heavy floor impact sounds. If any sharp transient type impulse is applied on the carpets, most of the heavy impact is transmitted to the floor panel located directly below, which in turn constitutes an impact transmission path into a supporting structural floor such as a concrete slab, resulting in vibration of the floor and generation of floor impact sounds.

In order to minimize the impact sounds transmitted to the room located directly below, extensive efforts have been made and led to development of floating floors with relatively effective impact sound insulating performance. For example, there is a floating floor comprising a buffer layer of glass wool arranged on a concrete slab, a plurality of floor panels arranged on said buffer layer to constitute a floating subfloor, and a finish floor such as carpets or wooden boards. In such a floating floor structure, if any heavy impact is applied to the floor, the impact force is centered on a part of the buffer layer because of the bending deformation of the floor panel located directly below, and then transmitted directly to the concrete slab without being absorbed by the buffer layer. Thus, it is difficult with this floor construction to obtain effective buffering properties.

On the other hand, there has been proposed a floating floor having a construction as shown in FIG. 20 that comprises a buffer layer B arranged on a concrete slab A, supporting members C such as joists arranged in parallel at suitable spaces on the buffer layer B, floor panels D arranged on the supporting members C to form an air layer E between the floor panels D and the buffer layer B, and a finish floor F. In this floating floor, if and heavy impact force P is applied to a point of the finishing floor F, the impact force P is distributed to the neighboring supporting members C and then transmitted to the buffer layer B. The distributed force $P_1$ is partially absorbed by the buffer layer B, so that the impact force acting on the concrete slab A is broken up, resulting in decrease of the floor impact sounds transmitted to the room located directly below.

Although the floating floor shown in FIG. 20 makes it possible to lower the heavy floor impact sounds to a level which meets the sound insulation class, L-55, specified in JIS A 1419, there is an increasing demand for development of multistory apartment buildings with a further improved floor impact sound insulating performance which satisfies the sound insulation class, L-50 or L-45, specified in JIS A 1419.

However, it is impossible with the above floating floor to provide a floor which will satisfy the sound insulation class, L-50 or L-45. If a heavy impact force is applied to the floor, the floor panel instantaneously produces deformation due to bending as shown in FIG. 20, which in turn generates large flexural vibrations. This flexural vibration varies in vibrating frequency with the size of floor panels and distances between supporting members C. The greater the magnitude of vibration and the longer the duration of vibration, the greater is the vibration transmitted to the concrete slab A. This results in an increase in the magnitude of impact sounds transmitted to the room located directly below.

In addition, the bending deformation of the floor panels causes compression of the air present in the air layer between the buffer layer B and the floor panels D since the supporting members C obstruct free flow of the air, although a part of the compressed air may escape sideways in the air layer. The compressed air in the air layer serves as an air cushion so that a force P' is transmitted to the concrete slab A through the buffer layer B and that the reaction force thereof acts on the floor panels D, resulting in flexural vibration of the floor panels. Thus, the flexural vibration of the floor panels D and concrete slab A are amplified by the forces due to the compression and expansion of the air in the air layer, resulting in increase in floor impact sounds transmitted to the room located directly below.

SUMMARY OF THE INVENTION

It is therefore an object of the present invention to provide an improved floating floor which makes it possible to lower the floor impact sounds transmitted to the room located directly below.

Another object of the present invention is to provide a floating floor in multistory apartment buildings that makes it possible to lower floor impact sounds transmitted to the room located directly below to a level which satisfies the sound insulation class, L-50 or L-45, specified in JIS A 1419.

It has now been found that the vibrations of the floor panels and supporting structural floor, which are amplified by the compression and expansion of the air in the air layer, may be reduced by releasing the air in the air layer into the atmosphere through the floor panels.

DETAILED DESCRIPTION OF THE INVENTION

According to the present invention, these and other objects are achieved by providing a floating floor comprising a plurality of square buffer members arranged in parallel at regular intervals on a supporting structural floor, a plurality of floor panels vertically spaced above the supporting structural floor by said supporting members to form an air layer between them, characterized in that the floor panels are respectively provided with a plurality of air holes through which the air layer is communicated with the outside of the floor panels.

In one preferred embodiment of the present invention, the floor panel is a hollow panel having a plurality of cavities extending in parallel in the longitudinal direction of the panel and being opened at butt ends of the panel, each of said cavities being communicated with the air layer through said air holes to form passages from the air layer to the outside of the floor panel.

According to the present invention, there is also provided a floating floor comprising a buffer layer arranged on a supporting structural floor, a plurality of floor panels vertically spaced above the buffer layer by square supporting members to form an air layer between them, said supporting members being arranged in parallel at proper spaces between the buffer layer and floor panels, characterized in that the floor panels are respectively provided with a plurality of air holes through which the air layer is communicated with the outside of the floor panels. The floor panel may be a hollow panel having a plurality of cavities extending in parallel in the longitudinal direction of the panel and being opened at butt ends of the panel, each of said cavities being communicated with the air layer through said air holes to form passage from the air layer to the outside of the floor panel.

As the floor panels constituting a floating subfloor, there may be used those such as wooden panels, inorganic panels, composite wooden panels reinforced with a material having a high tensile strength such as, for example, iron plates, fiber glass reinforced plastic plates and the like to improve the flexural rigidity. The wooden panels include, without being limited to, plywoods, laminated veneer lumber (LVL), particle boards, wooden cement boards and the like. The inorganic panels include, without being limited to, reinforced mortar boards, concrete panels, glass fiber reinforced cement (GRC) panels, cement panels, and the like. These panels may be used in the form of a solid panel or a hollow panel.

In the floating floor with the above construction, if any impact force is applied to a surface of the floating floor, the impact force is distributed on the buffer members and then transmitted to the supporting structural floor. Since the distributed impact forces are effectively absorbed by compressive deformation of the buffer members, the impact forces acting on the supporting structural floor are reduced effectively. On the other hand, the impact force causes the floor panel deformation due to bending, which in turn causes compression of air in the air layer located directly below. A part of the compressed air may escape sideways in the air layer and another part of the compressed air flows into the cavities through the air holes and is then released into the atmosphere. Thus, the compression of the air is minimized by the air which flows out of the air layer. In the next instant, the floor panel is bent in the reverse direction by the reaction, causing expansion of the air in the air layer. But the expansion of the air is minimized by the air which flows into the air layer through the cavities and then air holes. Accordingly, the forces acting on the floor panels and the structural floor are considerably decreased, resulting in decrease in vibration of the supporting structural floor and panel. For the reasons mentioned above, it is possible to lower the impact sounds generated by the supporting structural floor and then transmitted to the room located directly below.

The floating floor according to the present invention makes it possible to lower the floor impact sound level which satisfies the sound insulation class, L-50 or L-45. In addition, the outflow and inflow of the air contribute to avoid stay of moisture under the floor, thus making it possible to avoid dew condensation under the floor.

The invention will be further apparent from the following description taken in conjunction with the accompanying drawings which show, by way of example only, several preferred embodiments of the present invention.

PREFERRED EMBODIMENT OF THE INVENTION

Figure 1:
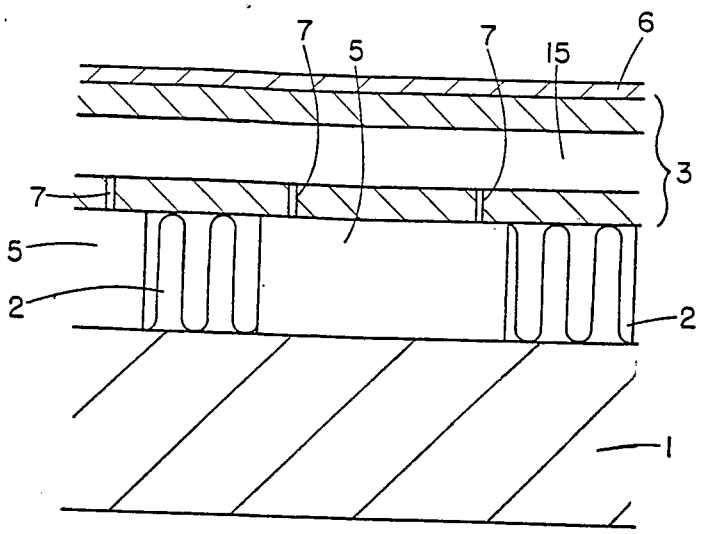
FIG. 1 is a section view showing a construction of a floating floor embodying the present invention.
Figure 2:
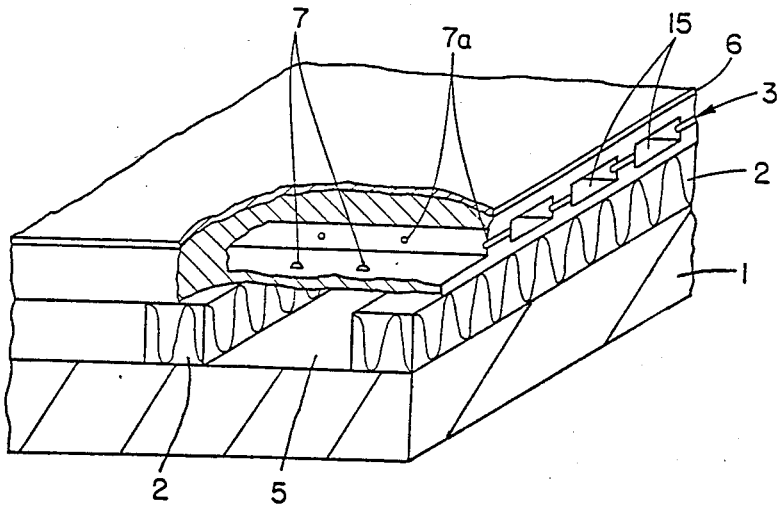
FIG. 2 is a partially cutaway perspective view of a part of the floating floor of FIG. 1.

Referring now to FIGS. 1 and 2, there is shown a floating floor embodying the present invention, comprising a plurality of floor panels 3 which are vertically spaced above a supporting structural floor 1 such as, for example, a concrete slab by means of square buffer members 2 to form an air layer 5 between them. Arranged on the floor panels 3 are finish floorings 6. The buffer members 2 are composed of a porous material such as glass wool or rock wool, and arranged in parallel at proper distances on the supporting structural floor 1. The distances between neighboring two buffer members 2 may be widened to allow the air to flow freely in the horizontal direction. Also, the buffer members 2 may be provided at its top or bottom with notches or recess at proper intervals.

Each floor panel 3 is provided with parallel cavities 15 with a square cross section, which extend in the longitudinal direction of the floor panel 3 and are opened at the butt ends of the panel as best seen in FIG. 2. The floor panel 3 is also provided with a plurality of air holes 7 and 7*a*. The air holes 7 pass through a bottom face board of the floor panel to communicate the cavities 15 with the air layer 5, while the air holes 7*a* pass through timbers of the floor panel 3 to communicate the cavities 15 with the neighboring cavities 15. The floor panels 3 are arranged side by side on the buffer members 2 so that the cavities 15 thereof extend in the direction perpendicular to the buffer members 2.

Figure 3:
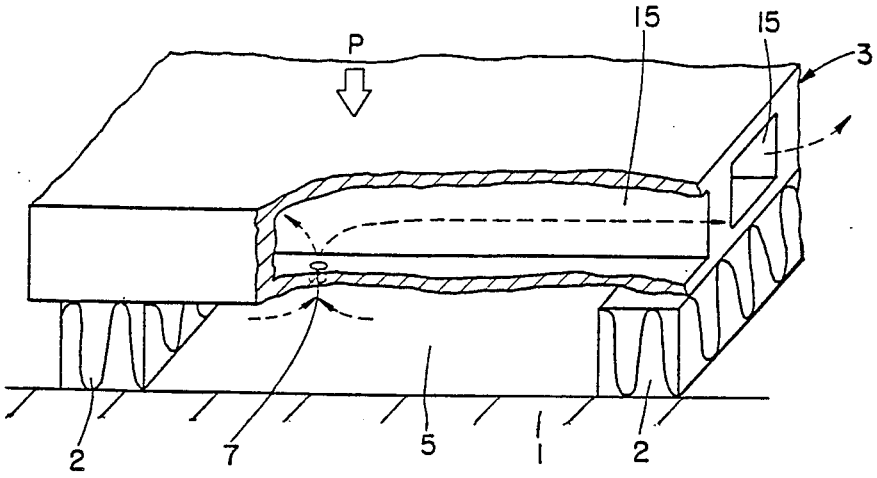
FIG. 3 is a perspective view similar to FIG. 2 illustrating flow of air in the floating floor in FIG. 1.

In the floating floor of FIGS. 1 and 2, if any heavy impact force P is applied to the top of the floating floor as shown in FIG. 3, the impact force P causes bending deformation of the floor panel 3 and is transmitted to the buffer members 2 through the floor panel 3. Since the impact force P is distributed to the buffer members 2 and the distributed impact forces $P_1$ are partially absorbed by the buffer members 2, the impact force acting on the structural floor 1 is lowered. Thus, the structural floor 1 is prevented from vibration.

Although the bending deformation of the floor panel 3 and the compressive deformation of the buffer members 2 result in compression of air in the air layer 5 located directly below, a part of the air flows into the cavities 15 of the floor panels 3 through the air holes 7 and is released into the atmosphere or room through the openings of the cavities 15. On the other hand, when the floor panel 3 is deformed in the reverse direction by its reaction, the air in the room flows into the air layer 5 through the cavities 15 and air holes 7 of the floor panel 3. The outflow and inflow of the air prevent the air layer from increase in the air pressure, resulting in lowering of the force of air acting of the supporting structural floor 1. This reduces not only the impact force transmitted to the structural floor 1 through the air, but also the reaction force due to the compressed air transmitted to the floor panel 3. Accordingly, the vibration of the floor panels 3 and the structural floor 1 are reduced, thus making it possible to lower the floor impact sounds transmitted to the room located directly below.

Figure 4:
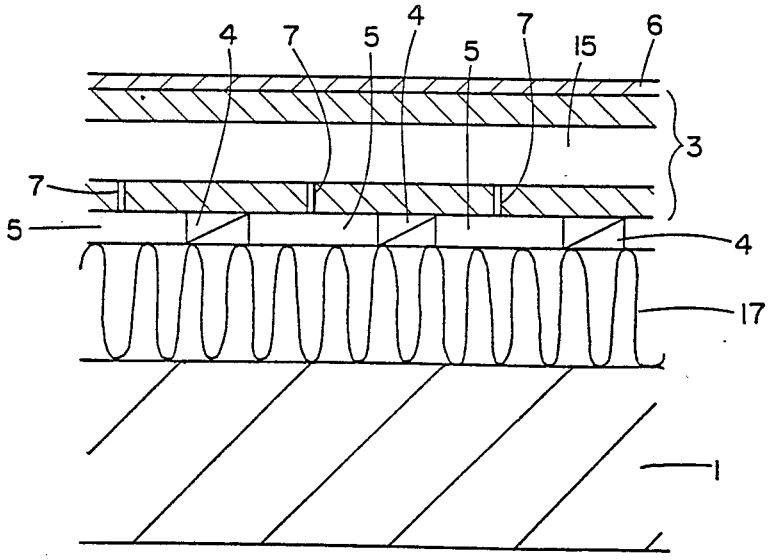
FIG. 4 is a section view similar to FIG. 1, showing another form of a floating floor according to the present invention.
Figure 5:
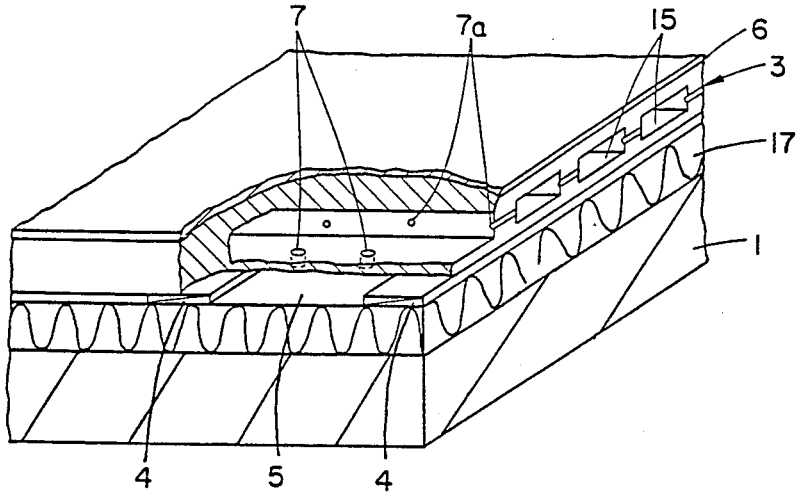
FIG. 5 is a partially cutaway perspective view of a part of the floating floor of FIG. 4.

FIGS. 4 and 5 show another form of a floating floor according to the present invention, which comprises a plurality of floor panels 3 vertically spaced above a buffer layer 17 by square supporting members 4 to form an air layer 5 between them. The supporting members 4 are arranged in parallel at regular spaces on the buffer layer 17 which is in turn arranged on a concrete slab 1. Each of the floor panels 3 is provided with parallel cavities 15 with a square cross section, which extend in the longitudinal direction of the floor panel 3 and are opened at its butt ends as shown in FIG. 5. The floor panel 3 is also provided with air holes 7 passing through its bottom face board to communicate the cavities 15 with the air layer 5, and air holes 7*a* passing through the timbers of the floor panel 3 to communicate the cavities 15 with the neighboring cavities 15. The floor panels 3 are arranged side by side on the supporting members 4 so that the cavities 15 thereof extend in the direction perpendicular to the supporting members 4. The floor panels 3 constitute a floating subfloor which is covered with finish floorings 6.

Figure 6:
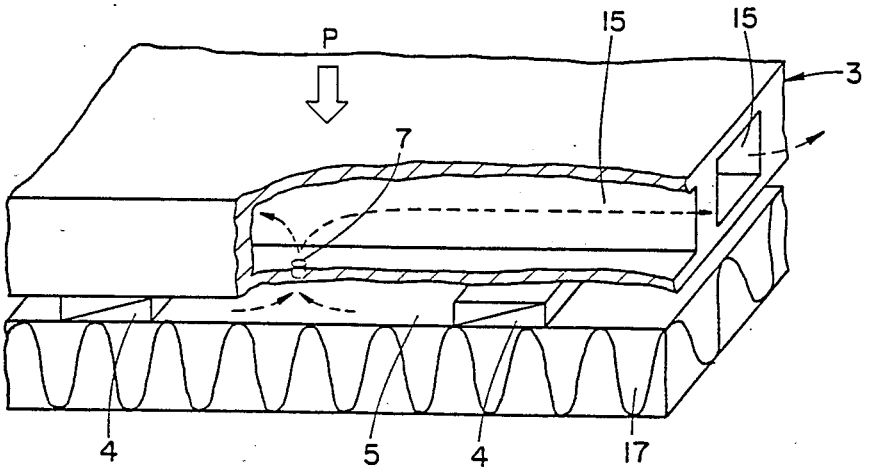
FIG. 6 is a perspective view similar to FIG. 5 illustrating flow of air in the floating floor shown in FIG. 4.

The floating floor has the same effects as those of the floating floor shown in FIGS. 1 and 2. If any heavy impact force P is applied to the floating floor as shown in FIG. 6, the impact force P causes bending deformation of the floor panel 3 and is distributed to the supporting members 4 by the floor panel 3. The distributed impact forces $P_1$ are transmitted to the buffer layer through the supporting members 4 and then are absorbed by the buffer layer 17, so that the impact force acting on the structural floor 1 is lowered, resulting in decrease in vibration of the structural floor 1.

The bending deformation of the floor panel 3 results in compression of air in the air layer 5 located directly below, and a part of the air is released into the atmosphere or room through air holes 7 and then cavities 15 of the floor panels 3. Thus, the air layer is prevented from increase in the air pressure, resulting in lowering of the force acting of the the supporting structural floor 1 through the air layer 5. On the other hand, the force exerted on the floor panel 3, the air and the structural floor causes a reaction, by which the floor panels 3 are bent in the reverse direction. The reverse bending deformation of the floor panel causes expansion of the air in the air layer, resulting in decrease in the air pressure in the air layer. This decrease of air pressure is minimized by the air which enters from the room into the air layer 5 through the cavities 15 and air holes 7 of the floor panel 3. Accordingly, the vibrations of the floor panels 3 and the structural floor 1 are reduced, thus making it possible to lower the floor impact sounds transmitted to the room located directly below.

Figure 7:
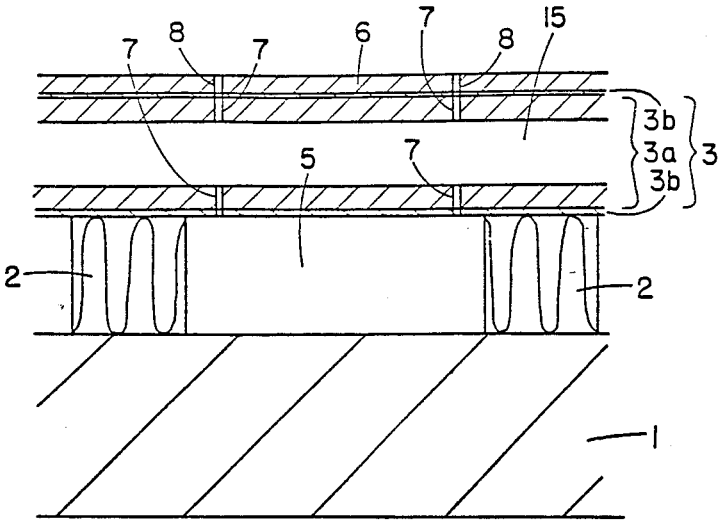
FIG. 7 is a section view showing a still another form of the floating floor according to the present invention.
Figure 8:
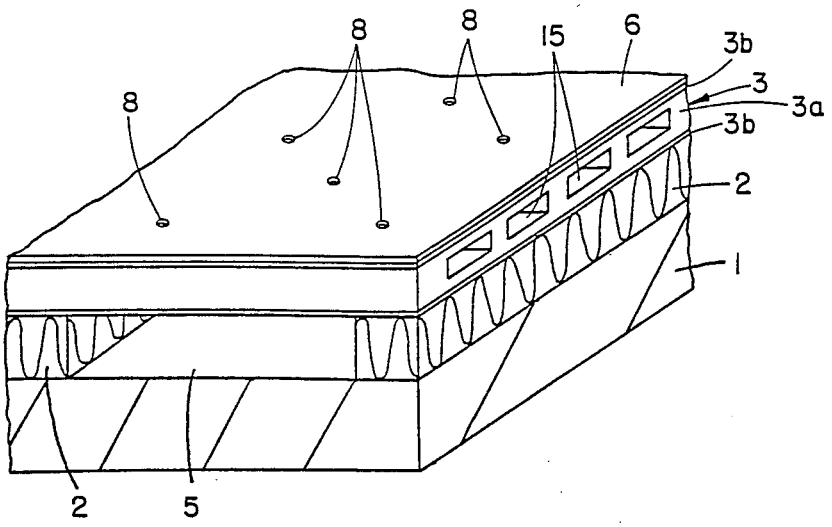
FIG. 8 is a partially cutaway perspective view of a part of the floating floor of FIG. 7.

FIGS. 7 and 8 show another form of a floating floor embodying the present invention, which comprises a plurality of buffer members 2, and a plurality of floor panels 3 arranged on the buffer members 2 to form a floating subfloor covered with a finish floorings 6. The buffer members 2 are arranged in parallel at proper spaces on a concrete slab 1 to form an air layer 5 between the panel 3 and the concrete slab 1. Each floor panel 3 comprises a hollow wooden board 3*a* reinforced with cement panels 3*b*, and is perforated to form air holes 7 passing therethrough. The finish floorings 6 are also provided with air holes 8 corresponding to the air holes 7 so that the air layer 5 is communicated with the room through the air holes 7 and 8 and cavities 15.

Figure 9:
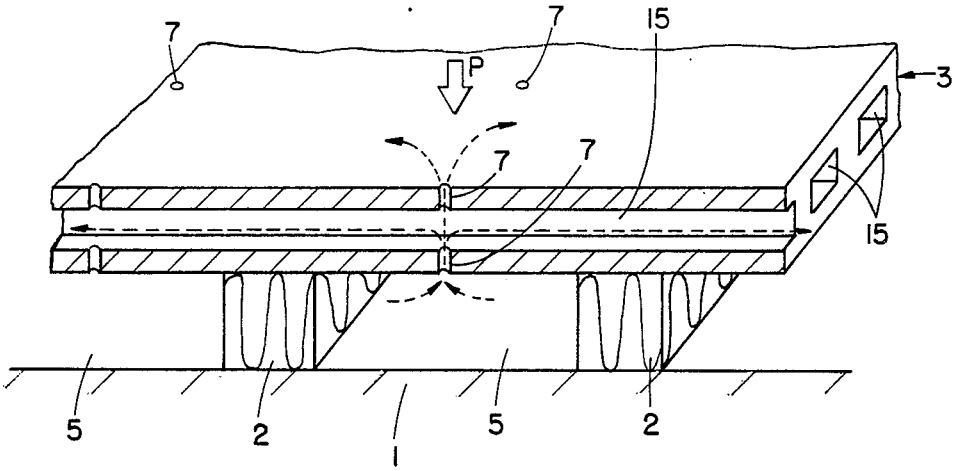
FIG. 9 is an enlarged perspective view of a part of the floating floor of FIG. 7, a finish floor being removed.

In this floating floor construction, if any impact load P is applied on the surface of the floor as shown in FIG. 9, the air compressed by bending deformation of the floor panel 3 enters into the cavities of the floor panels 3 through the lower air holes 7 and then flows out of the cavities 15 through the air holes 8 of the finish floorings 6. In this case, it is preferred to cover the finish floorings 6 with a breathable material such as carpets. The floor panels 3 may be provided with a plurality of additional air holes at its side walls partitioning the adjacent cavities as in the embodiment of FIGS. 1 and 2.

Figure 10:
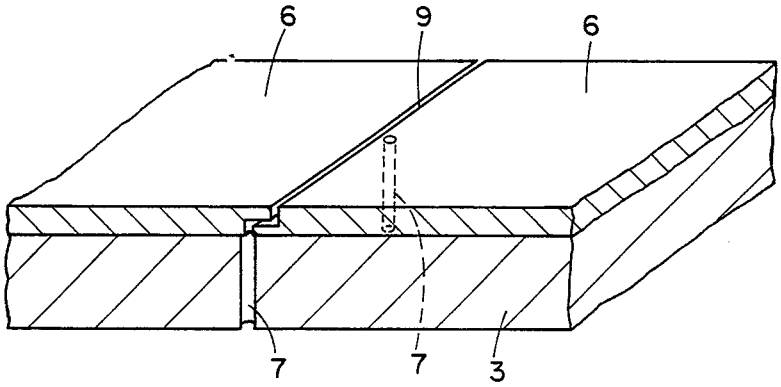
FIG. 10 is a partial perspective view of a modified form of the floating floor, showing flow of air passing through the floating floor.

In order to promote the outflow of air from the floor panels 3, it is preferred to form gaps 9 between adjacent finish floorings 6 as shown in FIG. 10. In this embodiment, the finish floorings 6 are joined one another by a halving joint so that the gap between the neighboring finish floorings 6 is positioned just above each row of the air holes 7 of the floor panels 3. The gap may be replaced with perforations which are drilled in the finish floorings in rows.

Figure 11:
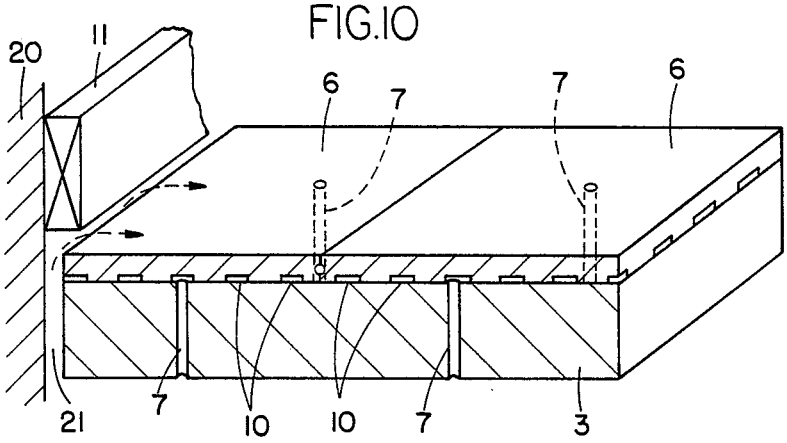
FIG. 11 is a partial perspective view of a floating floor, showing flow of air passing through the floor panels.
Figure 12:
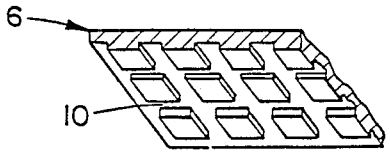
FIG. 12 is a perspective view of a finish floor, taken from the bottom in FIG. 11.

A floating floor shown in FIGS. 11 and 12 comprises finish floorings 6 provided at their undersides with vertical and horizontal channels 10 to form air passages between the floor panels 3 and the finish floorings 6. The air passage may be formed by net-like members arranged between the finish floorings 6 and floor panels 3. The finish floorings 6 are arranged on the floor panels 3 so that the channels 10 are positioned just above the air holes 7 of the floor panels 3. The floating floor is so constructed that there exist spaces 21 between walls 20 and sides of the floating floor and between baseboards 11 and the edge of the floating floor. If any heavy impact force is applied to the floating floor, the air passing through the air holes 7 may flow into the room through the channels 10 and spaces 21. In this case, the finish floorings 6 may be joined so that there is a gap between the neighboring finish floorings 6. Also, the air may be released from the air layer through a gap between a back of the wall, i.e., a finish wall face and a concrete wall.

Figure 13:
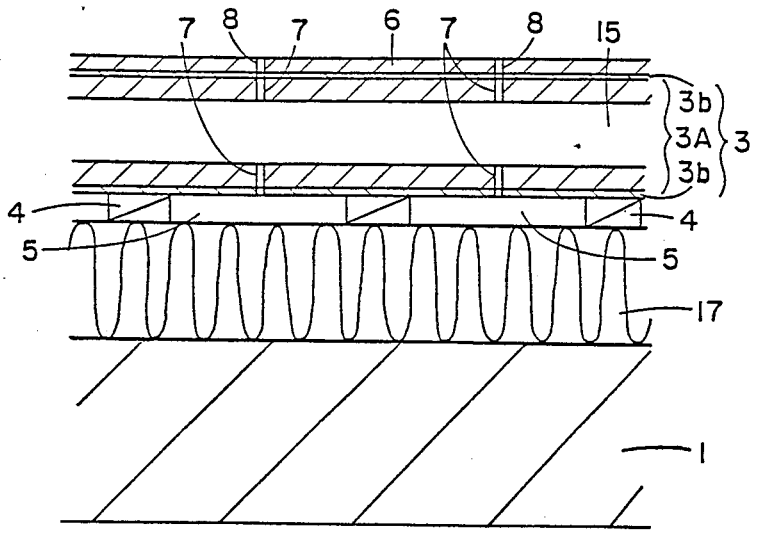
FIG. 13 is a view similar to FIG. 8, showing another form of a floating floor according to the present invention.
Figure 14:
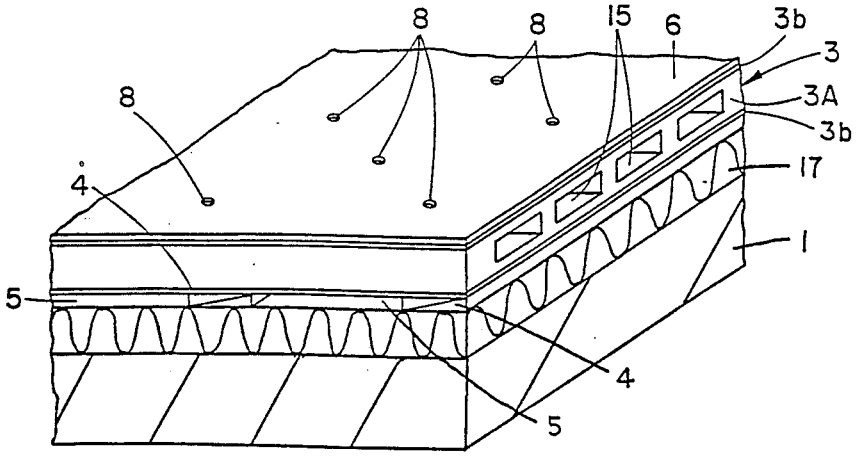
FIG. 14 is a perspective view of the floating floor of FIG. 13.
Figure 15:
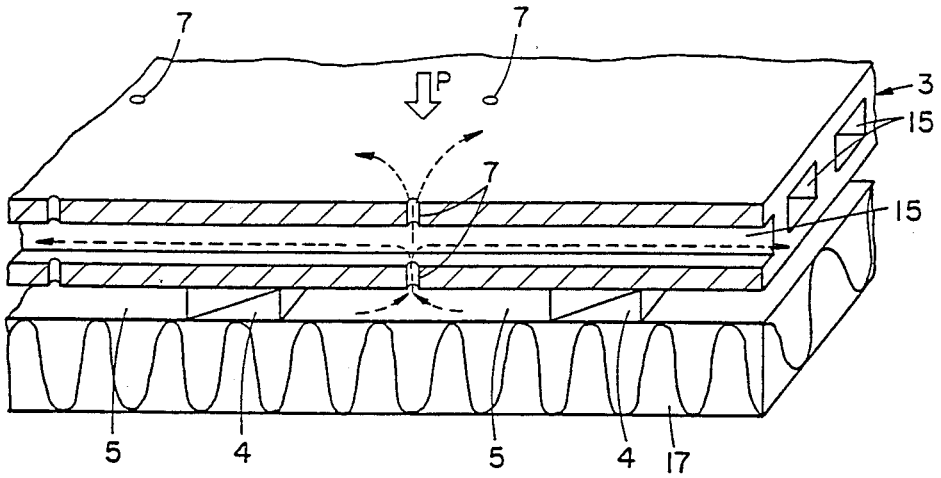
FIG. 15 is a cutaway perspective view of a part of the floating floor shown in FIG. 14, showing flow of air when an impact force is applied to the floating floor.

Referring now to FIGS. 13 to 15, there is shown another form of a floating floor embodying the present invention. The floating floor has the same construction as that in FIGS. 7 and 8 except for that floor panels 3 are spaced above a buffer layer 17 by supporting members 4 to form an air layer 5 between them. In this construction, if any impact load P is applied on the surface of the floor as shown in FIG. 9, the air in the air layer 5 enters into the cavities of the floor panels 3 through the lower air holes 7 and is then released into the room through the air holes 8 of the finish floorings 6.

Figure 16:
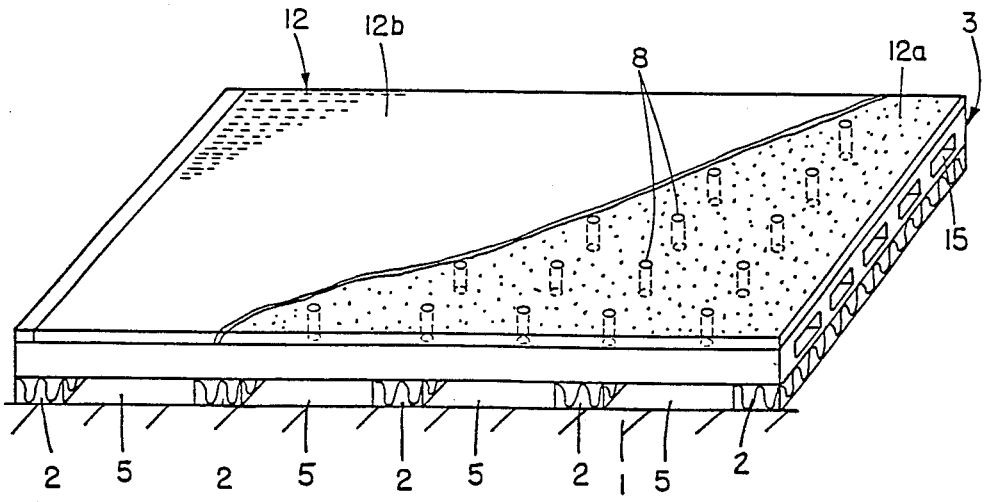
FIG. 16 is a partially cutaway perspective view of another form of a floating floor embodying the present invention.

FIG. 16 shows another form of a floating floor embodying the present invention. A finish floor is composed of a plurality of tatami mats 12 each comprising a tatami bed **12*a* covered with a tatami facing 12*b* with high gas permeability. The bed 12*a* is provided with air holes 8 passing therethrough at the positions corresponding to that of the air holes 7 provided in the floor panels 3. In this case, if an heavy impact is applied to the floating floor, the air in the air layer 5 flows out of the floating floor through the air holes 7 and 8 and then tatami facing 12*b***.

Figure 17:
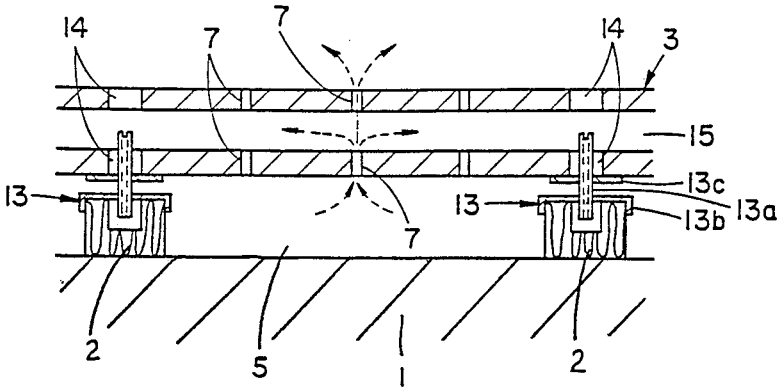
FIG. 17 is a section view of a floating floor, showing another form of the floating floor embodying the present invention.
Figure 20:
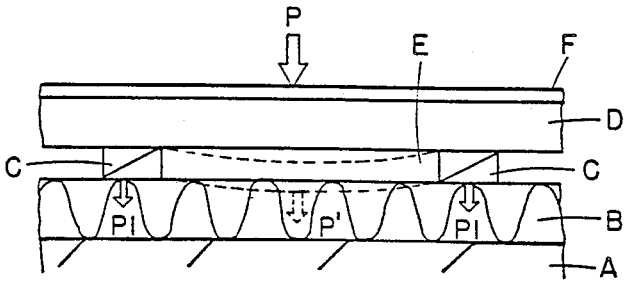
FIG. 20 PRIOR ART
FIG. 20 is a section view of a floating floor of the prior art.

Referring now to FIG. 17, there is shown another form of a floating floor according to the present invention, which comprises square buffer members 2 arranged at regular intervals on a supporting structural floor 1 such as concrete slab, and floor panels 3 arranged on the buffer members 2 to form a floating subfloor. The panels 3 have the same structure as that in FIG. 9. Arranged between the buffer members and the panels 3 are means for leveling floor panels. The leveling means 13 comprises a channel member **13*b* set on the buffer member 2, a supporting plate 13*c* for supporting floor panels 3, and an adjusting bolt 13*a* screwed at its lower portion into the channel member 13*b* and at its upper portion into the supporting plate 13*c*. The lower portion of the bolt 13*a* extends into a recess provided in the buffer member 2 and terminates therein, while its upper portion extends into a through hole 14 provided in the floor panel 3 and terminates therein. The panels 3 are leveled by adjusting the bolts 13*a* with a driver through the holes 14. In this case, the air flows out of the air layer 5 through the air holes 7 and cavities 15**.

EXAMPLE 1

In order to evaluate the impact sound insulating properties of the floating floor, a floating floor was constructed in the following manner: Firstly, there were prepared hollow floor panels of width 909 mm by length 1818 mm by thickness 60 mm, using composite panels composed of a plywood of thickness 15 mm and a slate of thickness 5 mm as face panels for floor panels, and square timbers of 20 mm by 20 mm. The square timbers were arranged between the face panels in parallel at intervals of 40 mm to form cavities between two face panels. One of the face panels was then drilled at intervals of 200 mm to form 40 air holes with a 15 mm diameter to complete the floor panel.

Buffer members of glass wool of density 64 kg/m$^3$ and thickness 50 mm were arranged on a concrete slab of thickness 150 mm and density 2300 kg/m$^3$ at pitches of 450 mm, and then the floor panels were arranged side by side to form a floating subfloor. Plywood finish floorings of thickness 12 mm were nailed on the floor panels to complete the floating floor.

Measurement of floor impact sound level was carried out by a method for field measurement of floor impact sound level, specified in JIS A 1418, using a heavy floor impact sound generating machine. Results are plotted in FIG. 18 by a solid line A. At frequencies exceeding 125 Hz, no floor impact sound level was detected. The concrete slab per se has impact sound insulating performance are also plotted in FIG. 18 by a solid line C.

For comparison, there was prepared a floating floor having the same construction as that of FIG. 7 except for that floor panels have no air hole. Results for this comparative floating floor are plotted by a solid line B in FIG. 18.

Figure 18:
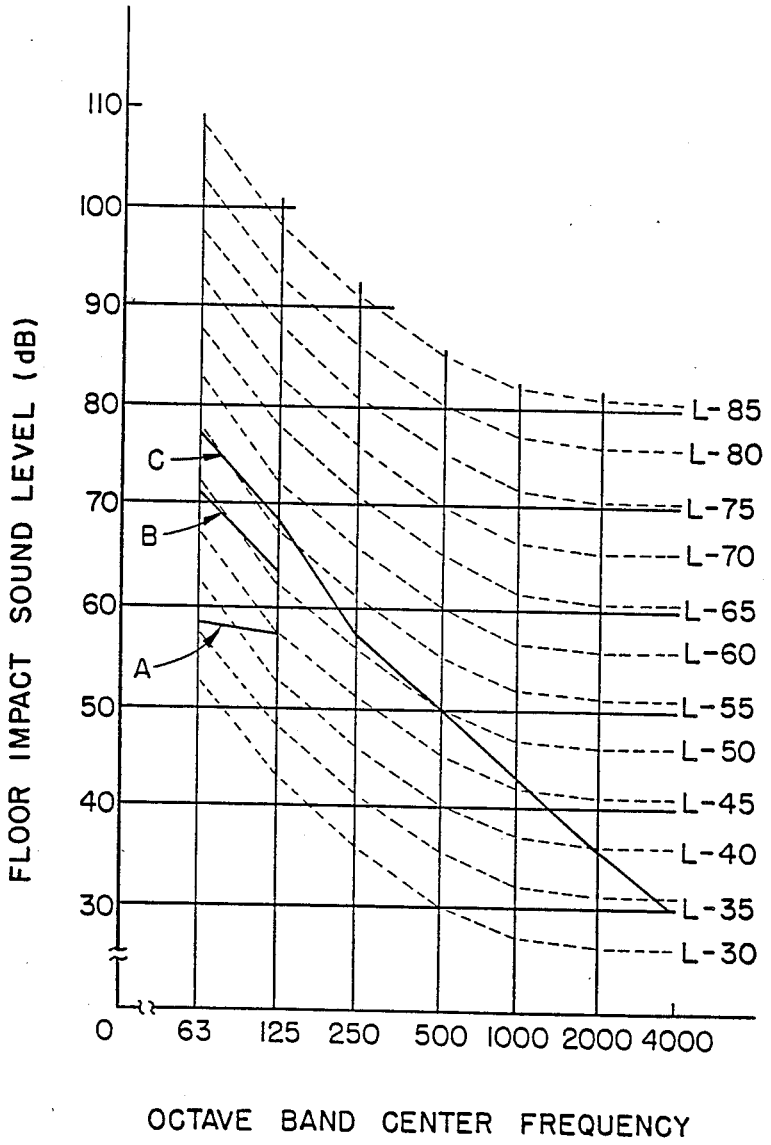
FIG. 18 is a graph showing the impact sound insulating performance of the floating floor of the present invention and that of the floating floor of the prior art.

From the results shown in FIG. 18, it will be seen that the floating floor of the present invention makes it possible to reduce the impact sound transmission through the floor, in particularly, at frequencies of the order of 63 Hz. Also, the floating floor of the present invention has excellent impact sound insulating performance which satisfies the sound insulation class L-44, specified in JIS A 1419.

EXAMPLE 2

There was prepared a floating floor in the following manner: Firstly, hollow floor panels of width 909 mm by length 1818 mm by thickness 60 mm were prepared, using composite panels composed of a plywood of thickness 15 mm and a slate of thickness 5 mm as face panels for floor panels, and square timbers of 20 mm by 20 mm. The square timbers were arranged between the face panels in parallel at intervals of 40 mm to form cavities between two face panels. The thus prepared floor panels were then drilled at its one side at intervals of 200 mm to form 40 air holes with a 15 mm diameter to complete floor panels.

A glass wool mat of density 64 kg/m$^3$ and thickness 50 mm was arranged on a concrete slab of thickness 150 mm and density 2300 kg/m$^3$ at pitches of 450 mm to form a buffer layer, and then square timbers of plywood having a thickness of 12 mm and a width of 60 mm were arranged on the buffer layer at pitches of 450 mm as supporting members. The above floor panels were arranged side by side to form a floating subfloor, and then plywood finish floorings with a thickness of 12 mm were nailed on the floor panels to complete the floating floor.

Measurement of floor impact sound level was carried out by a method for field measurement of floor impact sound level, specified in JIS A 1418. Results are plotted in FIG. 19 by a solid line A.

For comparison, there was prepared a floating floor having the same construction as that of Example 2 except for that floor panels have no air hole. Results for this comparative floating floor are also plotted in FIG. 19 by a solid line C. Also, results for the concrete slab per se are also plotted in FIG. 19 by a solid line D.

Figure 19:
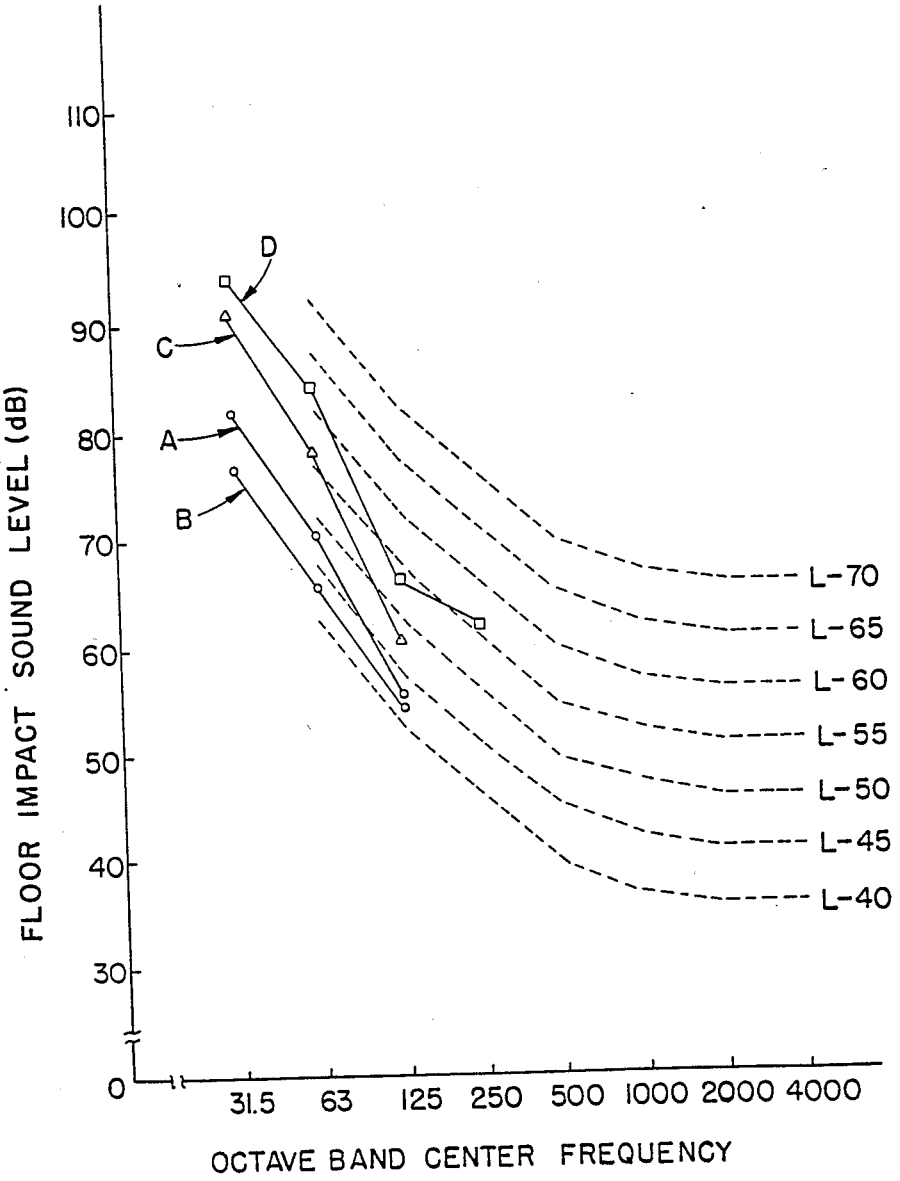
FIG. 19 is a graph showing the impact sound insulating performance of the floating floor of the present invention and that of the floating floor of the prior art.

As can be seen from the results shown in FIG. 19, according to the present invention, the impact sound transmision through the floating floor can be reduced by 5 to 15 dB compared with the floating floor of the comparative Example 2. Also, the floating floor of the present invention has excellent impact sound insulating performance which satisfies the sound insulation class, L-48, specified in JIS A 1419.

EXAMPLE 3

There were prepared floor panels having air holes passing through the upper and lower face panels in the same manner as in Example 2. Using these floor panels, a floor floating floor was constructed in the same manner as Example 2 except for that finish floorings were so joined that there exist gaps between joints of the finish floorings and that the joints are positioned just above the respective rows of air holes. The floor impact sound level was measured in the same manner. Results are also plotted by a solid line B in FIG. 19.

From the results shown in FIG. 19, it will be seen that the floating floor of the present invention makes it possible to lower the impact sound transmission through the floor. Also, the floating floor of the present invention has excellent impact sound insulating performance which satisfies the sound insulation class L-44, specified in JIS A 1419.

What I claim is:

1. A sound-insulated floatng floor for multistory apartment buildings, comprising a plurality of buffer members arranged in parallel at regular intervals on a structural floor of a multistory apartment building, a plurality of floor panels each having an upper and lower side, said floor panels being arranged side by side on said buffer members to form a floating subfloor and a finish floor laid on said subfloor, said buffer members being of an elastic material such as glass wool or rock wool and forming an air layer between said subfloor and structural floor, each said floor panel having a plurality of cavities and a plurality of air holes, said cavities extending in a direction parallel to longitudinal sides of each said floor panel and being opened at butt ends of said floor panel, said air holes communicating with said cavities and opened at least at the lower side of said floor panel to allow the air in said air layer to flow into and out of said cavities when any floor impact force is applied to the finish floor.

2. A floating floor according to claim 1 wherein each said floor panel is further provided with a plurality of air holes opened at the upper side of the panel so that said cavities are further communicated with the apartment room above said floating floor through said air holes.

3. A sound-insulated floating floor for multistory apartment buildings, comprising a layered buffer member of an elastic material such as glass wool or rock wool arranged on a structural floor of a multistory apartment building, a plurality of supporting members arranged in parallel at regular intervals on said layered buffer member, a plurality of floor panels each having an upper and lower side, said floor panels being arranged side by side on said supporting members to form a floating subfloor, a finish floor laid on said subfloor, said supporting members forming an air layer between said subfloor and layered buffer member, each said floor panel having a plurality of cavities and a plurality of air holes, said cavities extending in a direction parallel to the longitudinal sides of each said floor panel and being opened at butt ends of said floor panel, said air holes communicating with said floor cavities and opened at least at the lower side of said floor panel to allow the air in said air layer to flow into and out of said cavities when any floor impact force is applied to the finish floor.

4. A floatng floor according to claim 3 wherein each said floor panel is further provided with a plurality of air holes opened at the upper side of the panel so that said cavities are further communicated with the apartment room above said floating floor through said air holes.

* * * * *